US006508583B1

(12) United States Patent
Shankwitz et al.

(10) Patent No.: US 6,508,583 B1
(45) Date of Patent: Jan. 21, 2003

(54) AGITATED VESSEL FOR PRODUCING A SUSPENSION OF SOLIDS

(75) Inventors: Gregory P. Shankwitz, Landenberg, PA (US); Richard K. Grenville, Wilmington, DE (US); Kevin H. Tanner, Washington, WV (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/723,506

(22) Filed: Nov. 28, 2000

(51) Int. Cl.[7] ..... B01F 15/02; B01F 7/18

(52) U.S. Cl. ..... 366/196; 366/247; 366/307

(58) Field of Search ..... 366/302, 307, 366/196, 265, 325.92, 244, 245, 247

(56) References Cited

U.S. PATENT DOCUMENTS

| | | | | | |
|---|---|---|---|---|---|
| 10,245 | A | * | 11/1853 | Grover | 366/305 |
| 422,260 | A | * | 2/1890 | Stephens | 366/307 |
| 717,531 | A | * | 1/1903 | Beynon | 366/247 |
| 906,934 | A | * | 12/1908 | Rightmyer | 366/247 |
| 1,003,319 | A | * | 9/1911 | Barton | 366/307 |
| 1,101,199 | A | * | 6/1914 | Legg et al. | 366/247 |
| 1,536,375 | A | * | 5/1925 | Codding | |
| 1,716,363 | A | * | 6/1929 | Brooks | 366/307 |
| 2,122,187 | A | * | 6/1938 | Vollrath | |
| 2,159,856 | A | * | 5/1939 | MacLean | 366/307 |
| 3,404,870 | A | * | 10/1968 | Multer | 366/307 |
| 4,468,130 | A | | 8/1984 | Weetman | |
| 4,552,463 | A | | 11/1985 | Hodson | |
| 4,614,439 | A | | 9/1986 | Brunt et al. | |
| 4,754,437 | A | * | 6/1988 | Doom et al. | 366/249 |
| 4,934,828 | A | | 6/1990 | Janssen | |
| 5,297,938 | A | | 3/1994 | Von Essen et al. | |
| 5,326,167 | A | * | 7/1994 | Ware et al. | 366/247 |
| 5,399,014 | A | | 3/1995 | Takata et al. | |
| 5,472,278 | A | | 12/1995 | Kawaoka et al. | |
| 5,944,418 | A | * | 8/1999 | Orr et al. | 366/245 |
| 6,296,384 | B1 | * | 10/2001 | Yatomi et al. | 366/325.92 |

OTHER PUBLICATIONS

Douglas E. Leng, Chemical Engineering Progress, "Succeed at Scale Up", pp. 23–31 (Jun. 1991).

Douglas E. Leng, NAMF Mixing Conference—Mixing XVII, "Industrial Mixing Problems, Causes and Solutions", Banff, Aug. 16, 1999.

Walter I. Badger and Warren L. McCabe, "Elements of Chemical Engineering", p. 512–513, McGraw–Hill, New York and London 1936.

* cited by examiner

*Primary Examiner*—Tony G. Soohoo

(57) ABSTRACT

The invention provides an agitated vessel for producing a suspension of solids in liquid with uniform concentration. The vessel comprises a vertical cylindrical tank having sidewalls and a bottom with inclined surfaces forming an interior for holding a suspension of solids in liquid; means for feeding solids and liquid to the tank; a plurality of stationary baffles disposed in the interior of the tank and vertically extending the length of the tank; a rotating shaft vertically installed at the center of the interior of the vertical cylindrical tank; a single turbine impeller with vertical blades radiating from the rotating shaft, the lower edges of the blades being contoured to match the slope of the inclined surfaces of the bottom and positioned so that the lower edge of the impeller is close to the bottom; and an exit port. The agitated vessel achieves uniform concentration of suspensions at lower power requirements than traditional designs and in a low shear environment. The vessel is particularly good for handling floating solids and minimizing damage to friable products.

10 Claims, 4 Drawing Sheets

AGITATED VESSEL FOR PRODUCING A SUSPENSION OF SOLIDS

FIELD OF INVENTION

The invention relates to a mixing apparatus for producing a liquid suspension of solids with uniform concentration.

BACKGROUND OF THE INVENTION

Many chemical processes involve mixing operations that suspend solids in liquids such as mixing, crystallization, reaction and slurry suspension. Handling floating solids is often a significant aspect of a mixing operation. Solids may float for any number of reasons including low solid density, low bulk density and/or the non-wetting characteristics of a particular solid. Such solids float on a liquid's surface exposed to air and experience effects such as air entrainment. The ability to make a slurry of such materials typically requires the steps of submergence, degassing and distribution. Prior art solutions for distributing floating solids assumed that multiple levels of impellers are required. Most prior art devices positioned an impeller near the liquid/air surface to engage the floating solids and located at least one other impeller beneath the surface of the liquid in order to continue mixing the solids as they became submerged. However, for many operations such agitation results in the application of high levels of shear which cause product damage, especially if the solids are friable particulates. This is especially true if the mixing apparatus is being used in a transfer operation where batch operations may be subject to several hours of holdup time while experiencing extended periods of agitation. Prior art designs with multiple impellers for combining solids and liquid are described in U.S. Pat. No. 5,399,014 (Takata et al.), U.S. Pat. No. 4,614,439 (Brunt et al.), U.S. Pat. No. 4,934,828 (Janssen) and U.S. Pat. No. 4,552,463 (Hodson). Mixing that involves high energy input into a slurry may promote uniformity but is undesirable if product damage results.

Moreover, if the mixing tank is used as a feed tank to another operation in a chemical process, such as a drying operation, there is a need to avoid solids from settling in the bottom of the tank. The solids tend to remain in the tank at the end of a batch and accumulate from batch to batch. This is an unstable situation that may produce batch-to-batch non-uniformity and must eventually be addressed by shutting down the process and cleaning the tank when the solids concentration of the slurry becomes too high over time. Agitated vessels that can either maintain a uniform suspension or resuspend settling solids are desirable.

There remains a need for an agitated vessel design that produces a uniform concentration of solids in a liquid within a tank as well as in the effluent stream leaving the tank. The system should deliver a uniform concentration regardless of whether the solids tend to float or sink. The uniform concentration should be maintained from a full level in the mixing tank to as low of a level in the tank as is possible. The design should provide a maximum working volume in the tank and leave a minimum accumulation of slurry at the bottom of the tank as the tank is emptied. Finally, the system should create a low shear environment in order to avoid product damage.

BRIEF SUMMARY OF THE INVENTION

The invention provides an agitated vessel for producing a suspension of solids in liquid with uniform concentration.

The vessel comprises a vertical cylindrical tank having sidewalls and a bottom with inclined surfaces forming an interior for holding a suspension of solids in liquid; means for feeding solids and liquid to the tank; a plurality of stationary baffles disposed in the interior of the tank and vertically extending the length of the tank; a rotating shaft vertically installed at the center of the interior of the vertical cylindrical tank; a single turbine impeller with vertical blades radiating from the rotating shaft, the lower edges of the blades being contoured to match the slope of the inclined surfaces of the bottom and positioned so that the lower edge of the impeller is close to the bottom; and an exit port.

Preferably, the impeller in conjunction with the baffles produces an overall bottom-to-top flow of the suspension along the sidewalls in the tank.

In a preferred embodiment, the exit port is located on the sidewalls approximately at the height of the impeller for withdrawing suspension having uniform concentration.

DETAILED DESCRIPTION

Figure 1:
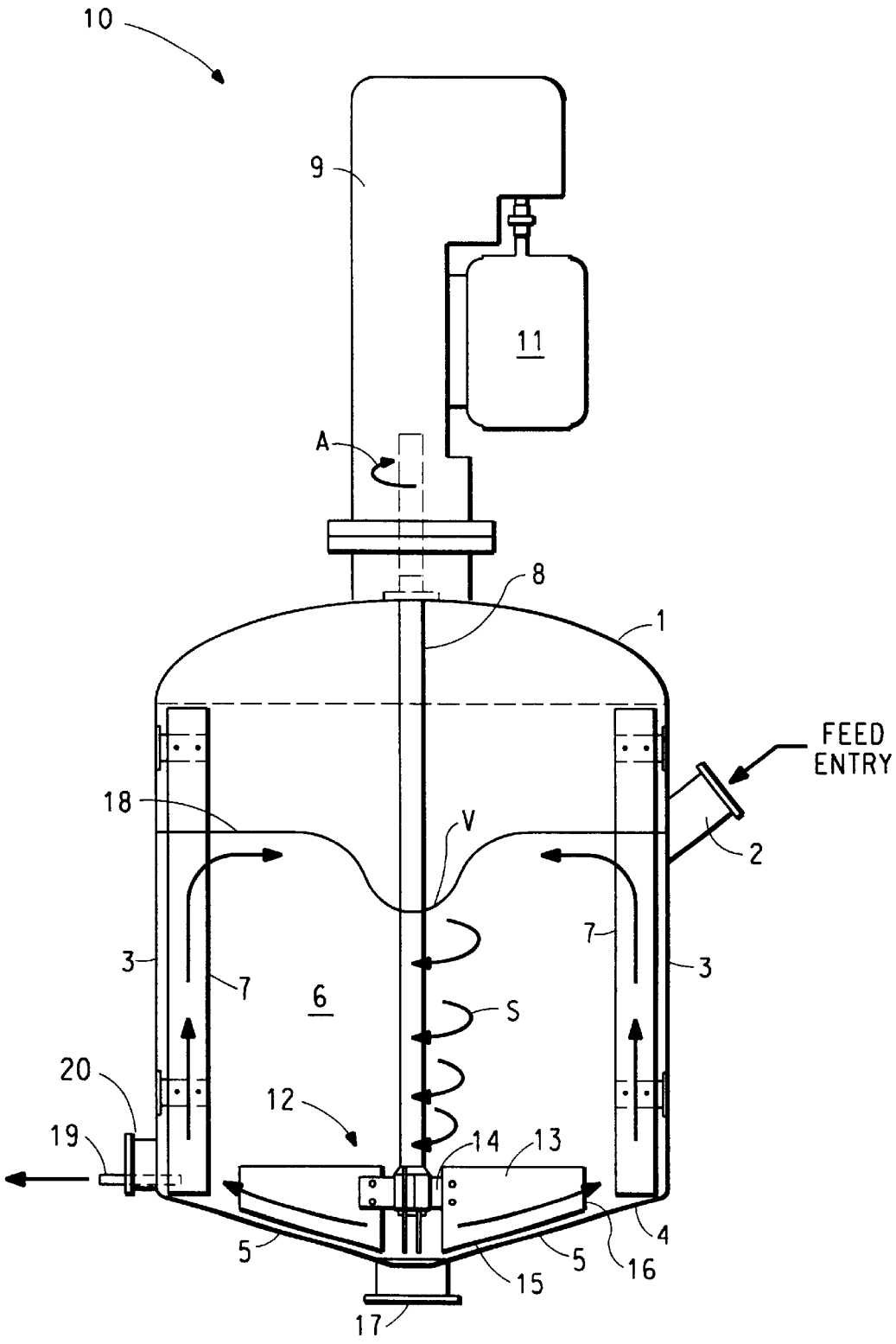
FIG. 1 is a sectional elevational view of a preferred embodiment of the agitated vessel according to the present invention. A pattern of suspension circulation in the vessel is diagrammed.

Referring to FIG. 1, there is generally shown a preferred embodiment of an agitated vessel 10 of the present invention used for producing and optionally supplying a suspension of solids in liquid with uniform concentration.

In this invention by the term suspension of solids, it is meant the distribution of solid particulate material throughout a liquid medium. The invention preferably produces as an end-product a suspension in uniform concentration which is then transferred out of agitated vessel 10 for use. However, subsequent to achieving distribution, the mixing operation may further achieve particle size reduction resulting in dispersion or even dissolution if the properties of solid and liquid permit. Alternatively, the agitated vessel 10 may be used in an environment that causes particles to grow in size such as use of the vessel as a crystallizer in which case growing particles are maintained distributed throughout the nurturing liquid without concern for particle damage.

Agitated vessel 10 includes vertical cylindrical tank 1 which has sidewalls 3 and a bottom 4 with inclined surfaces 5 that form an interior 6 for holding a suspension of solids in liquid. In a preferred embodiment the bottom 4 has inclined straight-line surfaces i.e., a conical shape of approximately 15 degrees as shown, but other designs with inclined surfaces, such as smooth curved lines that form a dish shape, are also useful. Means are provided to feed liquid and solids to vertical cylindrical tank 1. The means for feeding liquids and solids to the vertical cylindrical tank may be a vessel that contains both the liquid and solid components. The liquids and solids may be fed into the tank by a single feed entry port 2. Alternatively, solids and liquids may be fed by any suitable system (not shown) for feeding the solid and liquid components separately and may employ separate entry port for the solids and liquids.

A plurality of stationary baffles 7 is disposed in the interior 6 of tank 1 and extend the length of the tank, close to the conical bottom in order to insure an upward flow of the suspension towards the liquid surface as will be later explained. In a preferred embodiment, four full-length baffles 7 equally spaced are installed near sidewalls 3 but are offset from the sidewalls to allow for flow behind the baffles 7. In this preferred embodiment the baffles are offset from the wall by about 1.5 inches and extend to within 0.5 inch of the conical bottom. Compared to baffles found in conventional mixers which are typically 1/12 of the vessel diameter, the baffles in the preferred embodiment of this invention are relatively narrow. The width of each baffle is preferably less than 8% of the tank diameter and in the preferred embodiment described herein is 6.6%.

Figure 4:
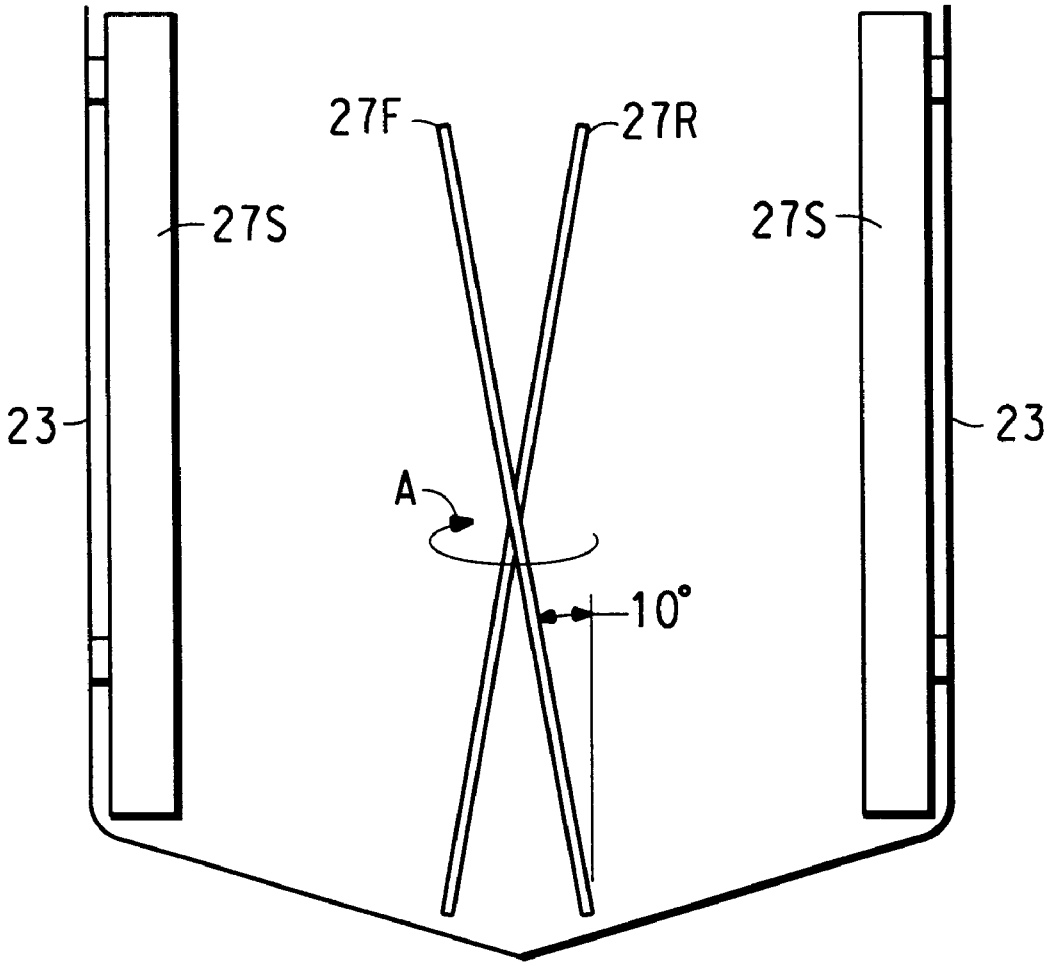
FIG. 4 is a sectional elevational view of the agitated vessel illustrating a preferred embodiment wherein the baffles are positioned at an angle to the vertical direction of the sidewalls.

The baffles as shown in FIG. 1 are generally positioned along the vertical direction of the sidewalls 3. However, in a preferred configuration as shown in FIG. 4, the baffles are positioned at a slight angle (approximately 10 degrees) from the vertical direction of the sidewalls. FIG. 4 is a view of vertical tank 21 from the front with four equally spaced baffles 27. Side baffles are labeled 27S. Front baffle 27F and rear baffle 27R are shown to be positioned at an angle of 10 degrees from the vertical direction of sidewalls 3, angled from the bottom to the top with the direction of impeller rotation indicated by arrow A. Baffles that are slightly angled have been found to aid in the flow of slurry and minimize plugging.

Referring to FIG. 1, a rotating shaft 8 is vertically positioned at the center of the vertical cylindrical tank 1 and rotated by gear box 9 mounted at the top of the mixing tank and driven by motor 11. Its rotational direction is indicated by arrow A. A single turbine impeller 12 with vertical blades 13 radiating from rotating shaft 8 is positioned so that the lower edges 15 of the impeller blades are as close to the bottom 4 of the tank as possible yet still allowing unobstructed rotation. The impeller blades 13 are contoured to match the slope of the inclined surfaces of the bottom 4 of the tank. The impeller initially produces a radial flow of the suspension. However, as will be discussed below, the overall vessel design that provides for vertical extending baffles in conjunction with an impeller positioned in the bottom of the tank, creates an overall bottom-to-top flow along the sidewalls 3. The impeller is positioned sufficiently close to the bottom of the tank so as to inhibit flow beneath the impeller. Tight clearances of from 0.5 to 3 inches, preferably 0.5 to 1 inch, from the lower edges 15 of the impeller blades 13 to the bottom of the tank are preferable to reduce solids accumulation in the tank, especially as liquid level 18 drops.

Figure 2:
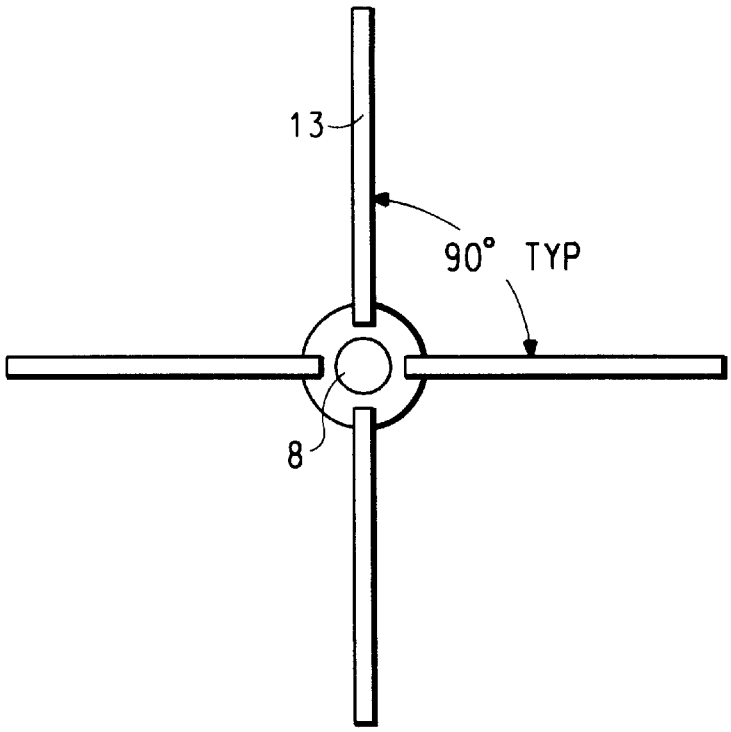
FIG. 2 is a fragmentary plan view showing a first arrangement of 4 vertical flat impeller blades.

The impeller 12 is a vertical turbine design and one embodiment is shown in FIG. 2 in plan view consisting of 4 vertical flat blades 13 spaced by 90 degrees. The inner portion 14 of each vertical blade is attached to drive shaft 8 and the bottom edge 15 of each blade 13 is angled so as to match the slope of the inclined surfaces of the bottom of the tank.

In a preferred embodiment, the blades of this invention are relatively narrow. The ratio of the blade width as measured along outer edge 16 to overall impeller diameter is between 1/12 and 1/3, preferably 1/8 and 1/4. The overall impeller diameter is relatively large wherein the impeller has a diameter equal to at least 60% of the diameter of the cylindrical tank.

Figure 3:
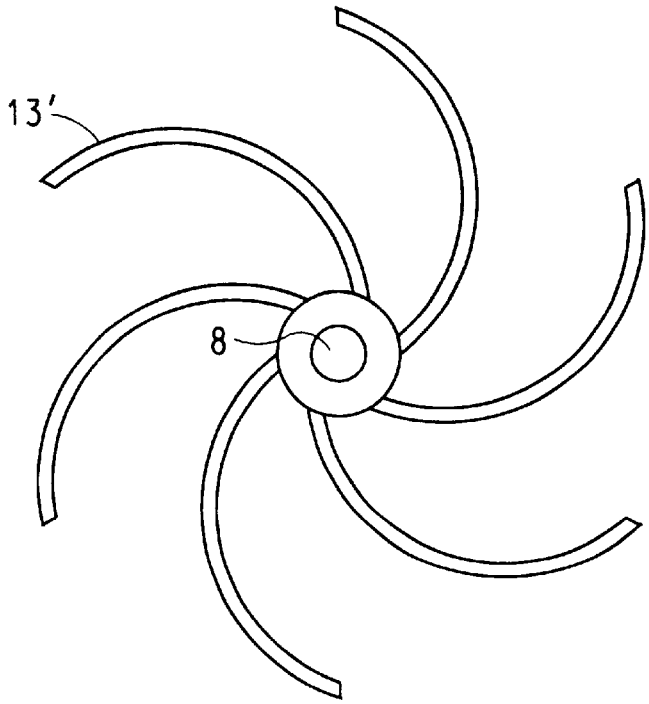
FIG. 3 is a fragmentary plan view showing a second arrangement of 6 vertical curved impeller blades.

An alternate configuration of blades is shown in FIG. 3 where the impeller is configured from 6 vertical curved (also commonly referred to as "backswept") blades 13'. The radius of curvature as shown is in the direction of the plane of rotation. The bottom edges of the impeller blades 13' are again contoured to match the slope of the inclined surfaces of the bottom of the tank.

An exit port 20 is located on the sidewall approximately at the height of impeller 12 (preferably approximately at the midpoint of the impeller along the vertical axis) so that the impeller acts to pump radially towards the exit port allowing for continuously withdrawing the suspension and maintaining uniform concentration in the effluent stream leaving the tank. As shown in FIG. 1, the exit port 20 is preferably a side nozzle with dip tube 19 protruding into the tank and into the radial flow created by the impeller.

The design of the present apparatus also includes a flush port 17 with an enlarged diameter to promote relatively large output as compared to exit port 20. The port 17 is generally not used in the routine operation of the vessel but is provided for the occasional cleaning and flushing of the vessel where it is desirable to remove all contents in a unit operation quickly.

Figure 5:
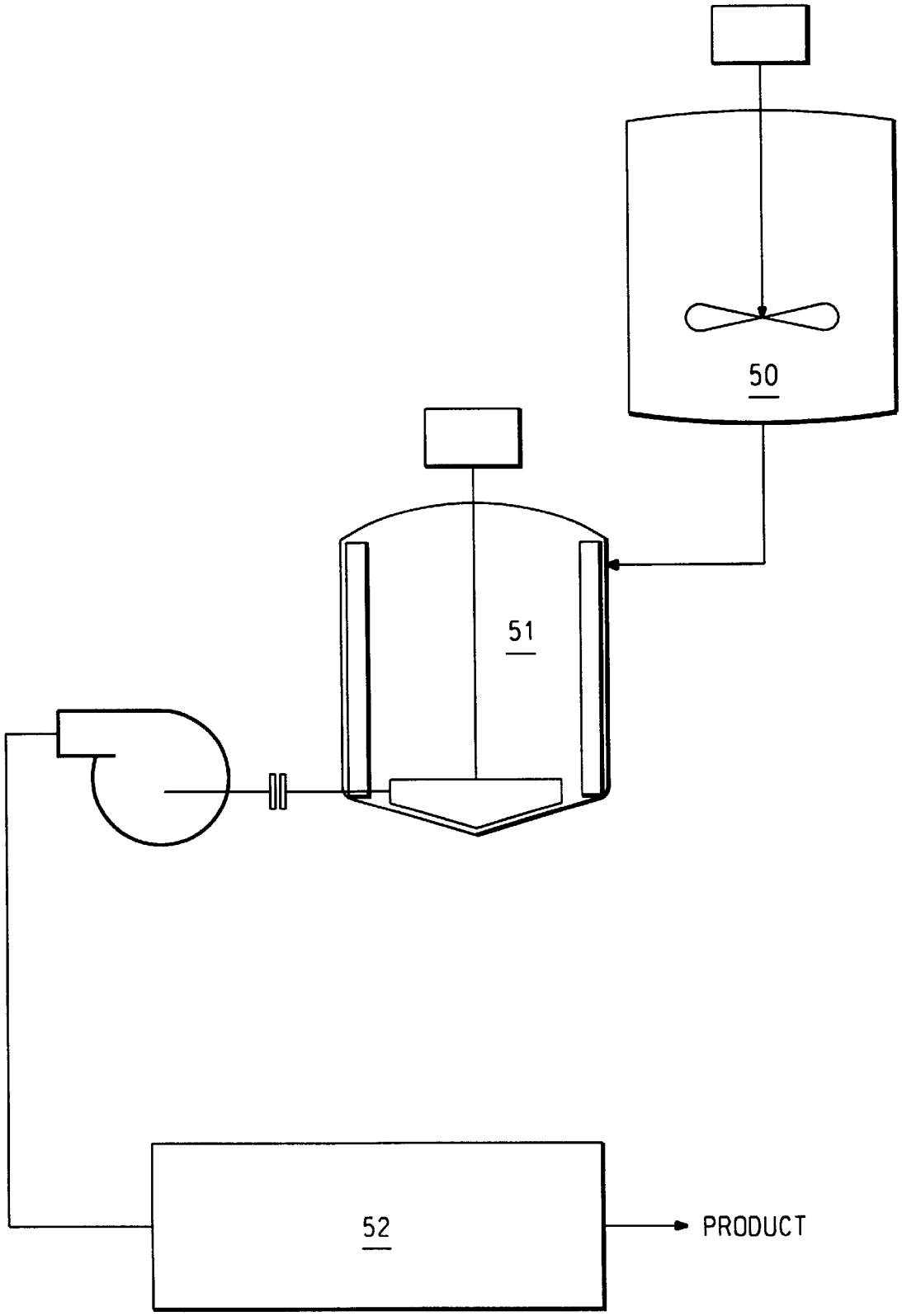
FIG. 5 is a schematic showing a general process diagram that uses the agitated vessel of the present invention.

The agitated vessel of the present invention may be effectively used in a number of chemical manufacturing processes. As shown in FIG. 5, a typical process flow sheet may include a first operation 50, a transfer tank 51 and a second operation 52. In this schematic, transfer tank 51 has the elements of the agitated vessel described in FIG. 1 in order to produce a suspension of uniform concentration. The first operation may be for example a reactor, crystallizer or pelletizer. The second operation may be for example a dryer, screener, filter or decanter.

The agitated vessel and impeller blades of this invention are commonly constructed of carbon steel, stainless steel, or alloys tailored to corrosive applications, such as HASTELLOY®, INCONEL® etc. For some extreme applications, titanium may be used. Equipment made from coated steel may likewise be used in particular applications and the coating may be, for example, glass, fiber glass, fluoropolymers, or elastomers. The vessel may alternately be constructed of fiber glass.

As further shown in FIG. 1, the agitated vessel in accordance with the invention imparts a unique circulation pattern to the suspension that allows for producing and maintaining uniform concentration of solids in liquid. The circulation pattern includes an overall bottom-to-top flow pattern along the sidewalls 3 in vertical cylindrical tank 1. A vortex V is formed at the liquid/air surface which causes floating solids to submerge and be pulled down in a tight spiral S toward impeller 12. The impeller pushes the suspension out to the sidewalls 3 radially toward baffles 7. The baffles extend the length of the tank and aid in sweeping the suspension straight up from the bottom to the top of the tank where the suspension again encounters the vortex causing resubmergence in a downward spiral.

In most operations, the suspension is subjected to agitation for some period of time until it is desirable to withdraw the suspension from the agitated vessel. Suspension having a uniform concentration of solids in liquid can be continually withdrawn from exit port 20 in the sidewall because, as the circulation pattern illustrates, the impeller 12 pushes the suspension radially in that direction, with little opportunity for accumulation of solids in the bottom of the tank. The same overall circulation pattern as illustrated in FIG. 1 can be maintained as the level of the suspension drops. Suspension is pumped out at a constant rate so that the exit velocity of the suspension regulated by the size of the dip tube 19 is equal to the velocity approaching the exit in order to keep the particle concentration changes small at the exit. If desired, the suspension exiting the vessel can then be supplied in a continuous, metered feed to a step further down in the process chain. Alternatively the suspension can be withdrawn from the vessel in small batches and fed to another process step, for example, a separation step like centrifugation. Meanwhile the suspension remaining in the vessel is maintained well distributed and the solids are not subjected to severe conditions that may result in particle damage.

The vessel described is in contrast to the prior art use of multiple impellers such as when one impeller is used at the upper level of the tank and one impeller is used at the bottom level of the tank. Circulation patterns in such prior art devices tend to set up two mixing zones: one at the top and one at the bottom, with a zone of separated liquid between the two mixing zones. With such a mixing regime, the concentration of solids in liquid can vary throughout the interior of the tank. If the level of the liquid drops below the level of the upper impeller, the circulation pattern typically changes and may adversely affect mixing. Further in conventional mixers, as the level drops through the upper impeller, the liquid surface hitting the impeller causes tremendous splashing potentially resulting in solids accumulation on sidewalls.

An unexpected feature of this invention is that uniform concentration of solids is achieved at lower power input than traditional designs which, for example, employ so called low shear hydrofoil impellers. Apparatus of this type is shown, for example, in U.S. Pat. No. 4,468,130 (Weetman). In a comparison test, a vessel with a 1 foot diameter (30 cm) of the present design and a similar vessel with a 1 foot diameter (30 cm) with hydrofoil impellers are evaluated in order to compare power consumption. The contoured impeller with 4 vertical flat impeller blades as illustrated in FIG. 2 is positioned low in the tank as described. However, the hydrofoil design does not permit contouring so the impeller is not positioned as low in the tank. In a first part of the test, both vessels are filled with equal water and solids concentration to determine the speed to achieve uniform mixing in each vessel. This is considered the initial speed for each vessel. In the second part of the test, each vessel is filled only with water and set at its initial speed and the DC volts and amps supplied are measured. Power consumption by the impellers is calculated including adjustment for motor losses. The agitators are also run at several speeds straddling the initial speed and the power consumption is measured to confirm the accuracy of the measurement at the initial speed. Power input per unit volume for the vessel of the present design used in this comparison is 3.2 horsepower per 1000 gallons (0.64 Watts/liter). Power input for the vessel with hydrofoil impellers used in this comparison is 5.4 horsepower per 1000 gallons (1.1 Watts/liter). The contoured vertical impeller of the present invention delivers an equivalent level of mixing at approximately 60% the power requirement as the hydrofoil impeller.

The power input for vessels of the present invention is preferably in the range of 0.1 to 50 horsepower per 1000 gallons (0.2–10 Watts/liter), more preferably in the range of 2.5–18.0 horsepower per 1000 gallons (0.5–3.5 Watts/liter). The vessel design as described results in less damage to the product and lower power consumption. The result is unexpected since vertical turbine impellers are generally known for their high shear and high power characteristics.

Another unexpected feature is that by placing the single impeller at the very bottom of the tank, excellent submergence of floating solids is achieved. The prior art approach using multiple impellers places an upper impeller at a distance approximately ½ of its diameter below the top surface to assist with pumping the solids down into the bulk of the tank.

Also, unexpectedly, a suspension can still be effectively removed from the tank even when the liquid level is drained to the level of the impeller or even when it drops below the top of the impeller while maintaining a uniform concentration of solids in liquid. At low tank levels, the agitated vessel of the present invention pushes the remaining slurry towards the sidewall, with minimal splashing, to the exit port. In prior art designs using conventional hydrofoil or pitched blade turbines, e.g., as shown in U.S. Pat. No. 5,297,938 (Von Essen et al.), excessive splashing occurs as the level drops to the impeller subjecting the product to potential damage. As the level drops below the impeller in prior art designs, solids and liquid can separate thereby destroying the uniformity of concentration. A large heel of solids will remain in the tank due to the liquid being drawn off preferentially (for floating solids) as uniformity of mixing is lost. With the present invention, solids accumulation in the bottom of the tank is avoided. Good mixing is achieved even at very low levels in the tank. The design provides a maximum working volume in the tank and leaves a minimum heel of solids at the bottom of the tank as the tank is emptied.

The present invention allows removal of up to 95% of the suspension formed. Therefore, when the agitated vessel is used as a device for mixing and supplying the product to another step in a batch process, there is a minimum heel that will combine with the incoming batch. Overworking and degradation of material accumulated from a previous batch is thereby minimized.

The agitated vessel as described may be used to suspend any type of solids in liquid and is particularly useful for suspending floating solids. By floating solids, it is meant particulates or agglomerates that have a tendency to float. Such floating solids may be of low solid density or low bulk density or have non-wetting characteristics. The vessel is particularly adapted for suspending nonwetting solids. By nonwetting solids is meant that the solids are repellant to the liquid media in which they are being mixed. Nonwetting solids are subjected to an upward force due to surface phenomena that make them float on an interface despite their densities. When submerged they are often found to be wrapped with a gas film that lowers their effective density. They then behave like low density, floating solids. Solid agglomerates can behave like nonwetting solids until they are distributed.

In addition to using the agitated vessel to obtain uniform suspension concentration, the vessel can also be used to promote dissolving, crystallization, and chemical reaction. For processes that require good dissolution, particles need to be in intimate contact with the liquid in which they are dissolving. The present invention minimizes settling out or floating of dissolving particles. Dissolving times are minimized as diffusion through a bed of settled solids is essentially eliminated. The impeller of the present invention increases contact of liquids and particles that leads to reduced power consumption. As a crystallizer, the vessel provides an environment for formation, growth and suspension of crystals without the concern for high shear that may cause damage to the growing crystals. The crystals when reaching a certain size can be continuously removed in a suspension of uniform concentration and supplied to a drying operation, such as a filter or drier belt. The vessel of the present invention is particularly useful in many of the precipitation and crystallization processes associated with the formation of agricultural and pharmaceutical products. Several types of crystalline products that may advantageously be formed in vessels of this invention include, for example, adipic acid, calcium sulfate, barium sulfate, and sodium cyanide.

The vessel as described may also be used as a reactor or transfer tank in the processing of polymer products such as polystyrene, polytetrafluoroethylene, etc.

In a polymer process such as the formation of polytetrafluoroethylene (PTFE), there are numerous processing steps that provide the polymer in various forms such as fine cut granular resin or pelletized granular resin. In such processes the PTFE is often handled as a suspension of a floating solid product in water and mixed within agitated vessels. The vessel of the present invention is able to serve as a transfer tank when individual batches require holding time with subsequent feed to screening and drying operations. A uniform concentration of solids exiting such feed tanks is desired to ensure stable and continuous operation of the screening and drying operations at maximum throughput. Such mixing as described herein produces batch to batch uniformity while avoiding high energy input to the friable product.

The agitated vessel of the present invention also has use in processes to produce foamed-in-place beads such as in the formation of expandable polystyrene molded particles used as packaging materials. The process involves adding cylindrical thermoplastic polymer particles to a vessel of hot water containing a suspending agent with subsequent addition of a foaming or blowing agent. The vessel is heated to above the glass transition temperature of the polymer and the particles change from a cylindrical shape to a spherical shape during the heating cycle. Batches are cooled to ambient temperatures, vented to remove excess flammable blowing agent and the foamed beads are recovered. With prior art devices, ideal suspension conditions of these floating solids were never achieved as evidenced by particle agglomerates crusting on the walls, shaft, baffles and impeller. If suspension conditions were especially non-uniform, massive crusting or particle agglomeration could occur forming a solid bridging layer on the top surface of the liquid. In contrast in the agitated vessel of the present design, the polymer particles are uniformly distributed throughout the vessel and the solid particles near the top surface are kept in constant motion and continuously wet and renewed with suspending liquid, avoiding agglomeration and crust formation.

What is claimed is:

1. An agitated vessel for producing a suspension of solids in liquid with uniform concentration comprising:

a vertical cylindrical tank having sidewalls and a bottom with inclined surfaces forming an interior for holding a suspension of solids in liquid;

a means for feeding solids and liquid to said tank;

a plurality of stationary baffles disposed in said interior of said tank and extending the length of the tank;

a rotating shaft vertically installed at the center of said interior of said vertical cylindrical tank;

a single turbine impeller with vertical blades radiating from said rotating shaft, with lower edges of said blades contoured to match the slope of said inclined surfaces of said bottom and positioned so that the lower edge of the impeller blade is close to said bottom; and an exit port located on said sidewall approximately at the height of said impeller for withdrawing said suspension having uniform concentration.

2. The vessel of claim 1 wherein said bottom has a conical shape.

3. The vessel of claim 1 wherein said interior has four equally spaced baffles.

4. The vessel of claim 1 wherein said baffles are near but offset from said sidewalls.

5. The vessel of claim 1 wherein the width of each of said baffles is less than 8% of the tank diameter.

6. The vessel of claim 1 wherein said baffles are positioned along the vertical direction of said sidewalls.

7. The vessel of claim 1 wherein said baffles are positioned at a slight angle from the vertical direction of said sidewalls.

8. The vessel of claim 1 wherein said impeller has a plurality of vertical flat blades.

9. The vessel of claim 1 wherein said impeller has a plurality of vertical curved blades.

10. The vessel of claim 1 wherein said impeller has a diameter equal to at least 60% of the diameter of said cylindrical tank.

* * * * *